US010513275B2

(12) United States Patent
Ring et al.

(10) Patent No.: US 10,513,275 B2
(45) Date of Patent: Dec. 24, 2019

(54) SELECTIVE CUSHIONING APPARATUS ASSEMBLY

(71) Applicant: Strato, Inc., Piscataway, NJ (US)

(72) Inventors: Michael Ring, Lake Village, IN (US); Jonathan Sunde, Somerset, NJ (US)

(73) Assignee: STRATO, INC., Piscataway, NJ (US)

( * ) Notice: Subject to any disclaimer, the term of this patent is extended or adjusted under 35 U.S.C. 154(b) by 0 days.

(21) Appl. No.: 16/133,085

(22) Filed: Sep. 17, 2018

(65) Prior Publication Data

US 2019/0144014 A1 May 16, 2019

Related U.S. Application Data

(63) Continuation-in-part of application No. 15/814,853, filed on Nov. 16, 2017, now Pat. No. 10,308,263.

(51) Int. Cl.
*B61G 9/04* (2006.01)

(52) U.S. Cl.
CPC ..... *B61G 9/04* (2013.01)

(58) Field of Classification Search
CPC ... B61G 9/00; B61G 9/04; B61G 9/06; B61G 9/10; B61G 9/12; B61G 9/20; B61G 9/22; B61G 9/24; B61G 11/00; B61G 11/14
See application file for complete search history.

(56) References Cited

U.S. PATENT DOCUMENTS 2,469,126 A * 5/1949 Munro ..... B61G 9/06 213/46 A
2,559,743 A * 7/1951 Williams ..... B42D 5/008 213/44
2,728,465 A * 12/1955 Campbell ..... B61G 9/06 213/44
2,766,894 A * 10/1956 Campbell ..... B61G 9/06 213/46 R
2,825,472 A * 3/1958 Peterson ..... B61G 9/10 213/22
3,197,037 A * 7/1965 Willison ..... B61G 7/10 213/21
3,370,718 A * 2/1968 Waddell ..... B61G 9/10 213/32 R
3,800,961 A * 4/1974 Hawthorne ..... B61G 9/04 213/8
3,838,778 A * 10/1974 Appleton ..... B61G 9/06 213/45
5,487,480 A * 1/1996 Page ..... B61G 9/08 188/287
6,360,906 B1 3/2002 Kaufhold et al.
(Continued)

OTHER PUBLICATIONS

International Search Report for corresponding PCT Appl. No. PCT/US2018/061286 dated Jan. 25, 2019.

*Primary Examiner* — Jason C Smith
(74) *Attorney, Agent, or Firm* — Pearl Cohen Zedek Latzer Baratz LLP

(57) ABSTRACT

A selective cushioning apparatus for a railway car absorbs draft and buff loads applied to a coupler of a railway car during train assembly and normal operation. The apparatus according to the invention provides better cushioning than a conventional draft gear without the excessive travel and maintenance issues of a hydraulic cushioning unit. In embodiments, the selective cushioning unit is adapted to fit into an AAR standard pocket for a hydraulic cushioning unit.

16 Claims, 7 Drawing Sheets

(56) References Cited

U.S. PATENT DOCUMENTS

| | | | | |
|---|---|---|---|---|
| 6,446,820 | B1 * | 9/2002 | Barker | B61G 9/06 213/46 R |
| 6,681,943 | B2 | 1/2004 | Barker et al. | |
| 8,590,717 | B2 * | 11/2013 | Wilt | B61G 9/06 213/22 |
| 8,870,002 | B2 * | 10/2014 | Wilt | B61G 9/14 213/22 |
| 8,939,300 | B2 * | 1/2015 | Wilt | B61G 9/06 213/22 |
| 8,985,355 | B2 * | 3/2015 | Wilt | B61G 9/06 213/45 |
| 9,056,618 | B2 * | 6/2015 | Gagliardino | B22D 25/02 |
| D781,179 | S * | 3/2017 | Schoedl | D12/42 |
| 9,598,092 | B2 * | 3/2017 | James | B61G 7/10 |
| 9,669,848 | B2 * | 6/2017 | Creighton | B61G 9/10 |
| 9,789,888 | B2 | 10/2017 | Wilt et al. | |
| 9,868,453 | B2 * | 1/2018 | Johnson | B61G 3/06 |
| 10,011,288 | B2 | 7/2018 | Gagliardino et al. | |
| 10,086,852 | B2 * | 10/2018 | Iler | B61G 9/04 |
| 2008/0008225 | A1 * | 1/2008 | Ahmad | G01W 1/17 374/109 |
| 2008/0011700 | A1 * | 1/2008 | Brough | B61G 9/24 213/75 R |
| 2017/0080956 | A1 | 3/2017 | James et al. | |
| 2017/0166225 | A1 * | 6/2017 | Schoedl | B61G 9/04 |
| 2017/0210398 | A1 * | 7/2017 | Wilt | B61G 9/06 |
| 2018/0118235 | A1 | 5/2018 | Johnson et al. | |

* cited by examiner

SELECTIVE CUSHIONING APPARATUS ASSEMBLY

CROSS-REFERENCE TO RELATED APPLICATIONS

This application is a continuation-in-part of U.S. patent application Ser. No. 15/814,853, filed Nov. 16, 2017, which is hereby incorporated by reference.

BACKGROUND OF THE INVENTION

Railway cars in a train are connected to an adjacent car by a coupler. The coupler is joined to a yoke and the assembly is mounted in a railway car center sill. In "cushioned" railway cars, to prevent damage to the railway cars and the laded goods during operation, especially during assembly of the railway car train in the yard, various devices have been installed to absorb loads on the coupler so that impact forces transmitted to the railway car are reduced. Generally, either frictional draft gear or hydraulic units are used for this purpose.

In a conventional frictional draft gear, one or more elastic elements, such as a coil spring or a set of elastomeric pads, is enclosed in a housing mounted in the yoke behind the coupler. A piston-like element frictionally received in the housing absorbs buff loads transmitted via a coupler follower which moves inside the yoke in response to buff impact force applied on the coupler, and the draft gear is compressed in the yoke in response to buff and draft forces. The basic draft gear apparatus has been used for decades. However, in many cases unacceptably large forces are transmitted to the railway car and it would be a desirable advance in the art to provide a cushioning apparatus that dissipates more force during impact than the conventional draft gear.

A hydraulic cushioning unit comprises a piston received in a cylinder filled with fluid. Such devices may dissipate more energy than a conventional draft gear, but they are known to be prone to leakage. Further, a hydraulic unit has a response to impact loads characterized by longer travel for the amount of energy dissipated, which can negatively impact train handling. Also, the fluid in a conventional hydraulic unit does not cushion draft forces on the coupler.

U.S. Patent Application Publication No. 2017/0210398 is incorporated by reference herein for its teaching of draft gear functioning and measurement of energy absorption.

U.S. Pat. No. 5,487,480 is incorporated by reference herein for its description of a hydraulic end-of-car cushioning (EOCC) unit.

SUMMARY OF THE INVENTION

The invention is directed to a selective cushioning apparatus for a railway car that absorbs draft and buff loads applied to the coupler of the railway car. The apparatus according to the invention provides "softer" cushioning than a conventional draft gear without the excessive travel and maintenance issues of a hydraulic cushioning unit. In embodiments, a stack of elastomeric units may be adapted for installation behind a yoke having a draft gear therein to provide softer cushioning against buff loads and the standard pocket maybe lengthened. In other embodiments, the selective cushioning unit may be adapted to fit into an Association of American Railroads ("AAR") standard pocket, including a separate stack of elastomeric units in front of the rear wall of the yoke in addition to the stack of elastomeric units behind the yoke. Thus, the apparatus according to the invention may comprise separate stacks of elastomeric units adapted for installation with a yoke in a standard pocket or in a non-standard pocket.

It is desired to provide alternative end of car cushioning apparatuses that avoid the complications of hydraulic cylinders, which provide cushioning over a range of impact speeds with an energy absorption profile intermediate that of conventional hydraulic cushioning unit and draft gear.

Another object of the invention is to provide a cushioning apparatus for a railway car that provides cushioning for both draft and buff loads applied to the coupler, limiting force transmitted to the railway car over a range of impact speeds, such as may be encountered during train build, where impact speeds may be in the neighborhood of 3-14 mph or higher, and during start-up and stopping. Embodiments according to the invention may exhibit low displacement per unit of force applied over a range of relevant force levels.

Yet another object of the invention is to provide improved alignment and positioning of elastomeric pads in a cushioning device, to prevent over-compression, permanent deformation, and buckling during use, which ensures more reliable performance.

These and other objects of the invention are realized in one aspect with an end-of-car cushioning apparatus for a railway car, comprising: a yoke having a length, a front end, and a rear end opposite the front end. The yoke may have aligned apertures at the front end adapted to receive a pin or key for attaching the yoke to a railway car coupler and a vertical wall at the rear end. The apparatus further includes a coupler-receiving member (also referred to as the "coupler follower") adapted to receive buff force from the coupler and adapted to move inside the yoke. A first stack of elastomeric units is positioned between the coupler-receiving member and the vertical wall of the yoke, compressed in response to buff and draft loads on the coupler. (An "elastomeric unit" is defined herein as comprising a rigid plate and an elastomeric pad in a middle portion thereof). A second stack of elastomeric units is positioned behind the vertical wall of the yoke and is compressed in response to buff loads on the coupler. With the cushioning unit installed, the maximum force transmitted to a coupler during impact at a speed below 6 mph is 1.5 times the weight of the impact car. The maximum force transmitted to a coupler at a speed of 10 mph is 4.0 times the weight of the impact car. The maximum force (in klbs) transmitted to a coupler at a speed between 6 mph and 10 mph is defined by a line having slope 0.625.

In another aspect of the invention, an end-of-car cushioning apparatus for a railway car comprises a yoke having a length, a front end, and a rear end opposite the front end, having a vertical wall at the rear end and a draft gear positioned between the vertical wall and the front end of the yoke, such that the draft gear cushions buff and draft loads. A second stack of elastomeric units may be positioned behind the vertical wall of the yoke, such that the second stack of elastomeric units is compressed in response to buff loads on the coupler. The second stack of elastomeric units may be made of rigid metal plates with an elastomeric pad in the center of each plate, substantially laterally filling a cross section of the sill, which ensures alignment of the pads. The pocket may be non-standard and the number of elastomeric units may be selected to achieve the same cushioning level set forth above, i.e., a maximum force transmitted to a coupler with the cushioning apparatus during impact at a speed below 6 mph is 1.5 times the weight of the impact car; maximum force transmitted to a coupler at a speed of 10 mph is 4.0 times the weight of the impact car; and maximum force transmitted to a coupler (in klbs) at a speed between 6 mph and 10 mph is defined by a line having slope 0.625.

In still another aspect, the invention is an end-of-car cushioning apparatus for a railway car, comprising a rigid metal front plate, a rigid metal rear plate, a nested set of elastomeric units held between the front plate and the rear plate by at least one rod, each said elastomeric unit comprising a rigid metal plate with an elastomeric pad in a center portion thereof, wherein each plate has a protrusion and/or an indentation at a peripheral portion thereof for nesting with an adjacent plate to prevent compression of the elastomeric pads beyond a predetermined amount, and wherein the front plate, rear plate and each elastomeric unit plate all have substantially the same vertical cross-sectional dimension, which substantially fills a lateral dimension of a railway car center sill.

BRIEF DESCRIPTION OF THE FIGURES

The subject matter regarded as the invention is particularly pointed out and distinctly claimed in the concluding portion of the specification. The invention, however, both as to organization and method of operation, together with objects, features, and advantages thereof, may best be understood by reference to the following detailed description when read with the accompanying drawings in which:

Figure 1:
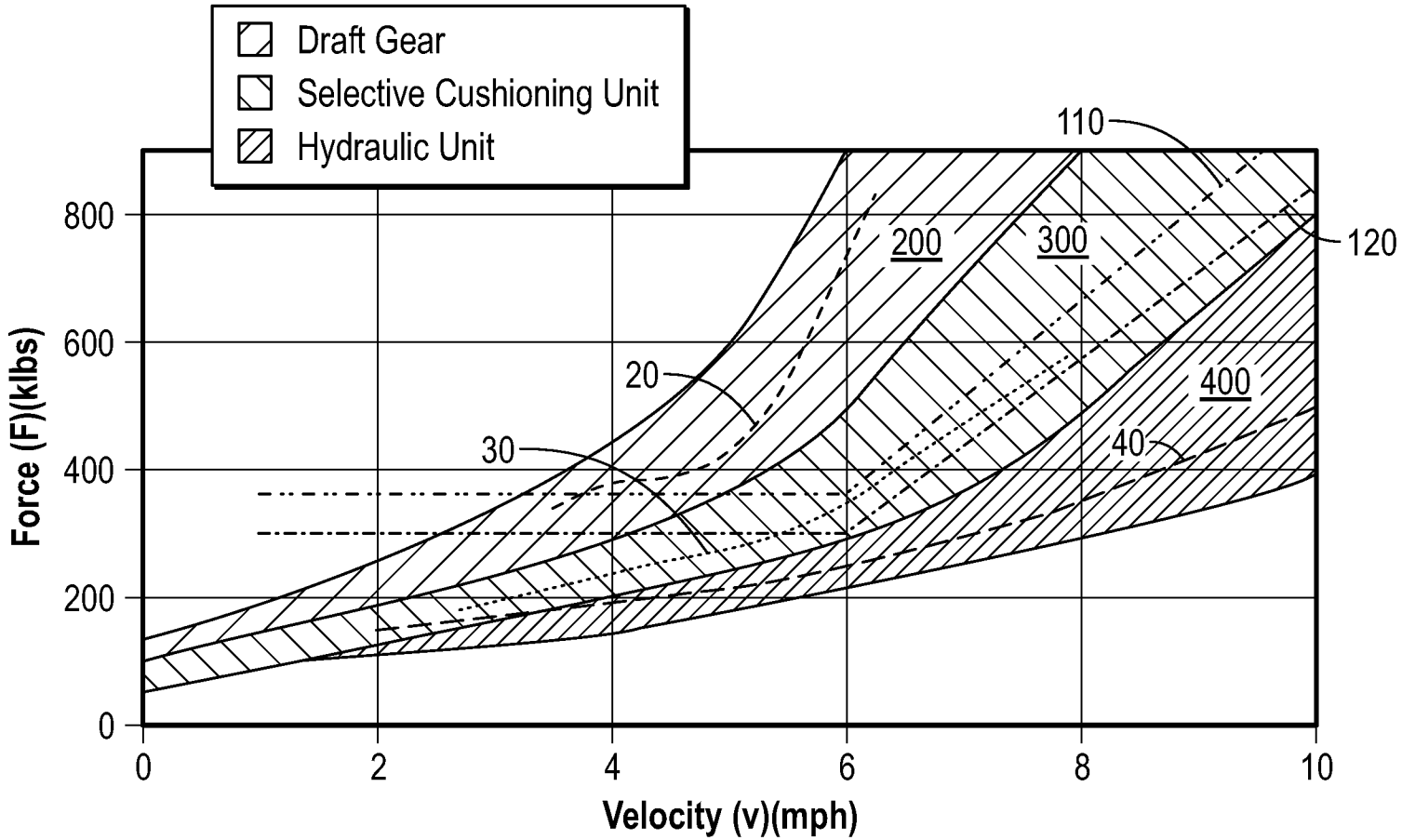
FIG. 1 is a force-velocity plot showing the impact performance of a draft gear and a hydraulic unit compared to a selective cushioning unit according to the invention.

The drawings may not be to scale and features not necessary for an understanding of the invention are not shown.

DETAILED DESCRIPTION OF THE INVENTION

Directions and orientations herein refer to the normal orientation of a railway car in use. Thus, unless the context clearly requires otherwise, the "front" of a coupler is in a direction away from the body of the car and "rear" is in a direction from the front end of the coupler toward the car body. Likewise, the "longitudinal" axis or direction is parallel to the rails and in the direction of movement of the railway car on the track in either direction. The "transverse" or "lateral" axis or direction is in a horizontal plane perpendicular to the longitudinal axis and the rail. The term "inboard" means toward the center of the car, and may mean inboard in a longitudinal direction, a lateral direction, or both. Similarly, "outboard" means away from the center of the car. "Vertical" is the up-and-down direction, and "horizontal" is a plane parallel to the surface the train travels on. A "cross-section" of the sill, yoke or cushioning unit is a vertical cross-section parallel with the front of the railway car.

"Elastomer" and "elastomeric" refer to polymeric materials having elastic properties so that they exert a restoring force when compressed. Examples of such materials include, without limitation, thermoplastic elastomer (TPE), natural and synthetic rubbers such as: neoprene, isoprene, butadiene, styrene-butadiene rubber (SBR), polyurethanes, and derivatives. Thermoplastic copolyesters used in some conventional draft gear may be used in the stacks of elastomeric units according to the invention.

As used herein, the term "about" associated with a numerical value is understood to indicate a margin of +/−20% of the value.

"Travel" refers to a distance traveled by the coupler follower upon impact and may also be referred to as "displacement". In some instances, clear from the context, "travel" refers to the full extent of movement, i.e., when the pads are fully compressed. In the case of a specific impact, such as depicted in FIGS. 2-5, "travel" is the amount of displacement encountered in a specific impact event. "Travel" in a hydraulic unit refers to the extent of travel of the piston in the cylinder during an impact event and depending on the context may refer to the complete stroke of the piston.

A person having ordinary skill in the art has a general knowledge of standards and procedures established by the Association of American Railroads ("AAR") and the published AAR standards cited herein are incorporated by reference as background. Reference herein to AAR standards refers to standards in effect on the filing date of this application. Draft gears for freight cars are certified under either section M-901E or section M-901G of the Association of American Railroads (AAR) Manual which require drop hammer tests. Hydraulic units are tested using dynamic impact tests set out in AAR standards M-921B or M-921D. In embodiments, the selective cushioning apparatus fits between front and rear stops of an "EOC-9" pocket of about 38¾ inches described in AAR standard S-183. In other embodiments, the cushioning unit fits in a pocket length of about 48¾ inches described in AAR standard S-184 for an "EOC-10" pocket. In other embodiments, the cushioning device may be adapted to fit other AAR standard or non-standard pocket dimensions depending on the application.

A cushioning apparatus according to the invention and component parts thereof may have the structures disclosed in co-pending U.S. patent application Ser. No. 15/814,853, filed Nov. 16, 2017 by the inventors herein, entitled Cushioning Apparatus for a Railway Car, which is incorporated herein by reference in its entirety.

Embodiments of the invention include a separate stack of elastomeric units for positioning behind a yoke, which may be a custom sized E-Type or F-type yoke adapted to fit with the stack of elastomeric units in an AAR standard pocket size as described in the aforesaid pending application Ser. No. 15/814,853. Alternatively, a stack of elastomeric units according to the invention may be paired behind a standard yoke to absorb additional buff forces and a pocket may be modified for a particular design. In either case, the stack of elastomeric units has characteristic features, including a rear plate, a front plate and a set of adjacent rigid plates with at least one elastomeric pad between adjacent rigid plates, together referred to as an "elastomeric unit".

The self-contained unit or "stack" comprises a front plate connected to a rear plate by at least one rod which passes through the elastomeric units. The ends of the rod may be mounted flush with the front plate respectively, such as by providing a recess in the front plate. In embodiments, each plate and elastomeric pad has a hole in the center to receive the rod. However, this arrangement may be varied without departing from the scope of the invention. For example, pads may have a rectangular shape, or an array of pads, of any shape, may be used. In preferred embodiments, the elastomeric unit(s) of a stack substantially fill a vertical cross section the sill area to help align elastomeric units and pads in the sill. Each elastomeric pad may be circular when viewed in plan, having an outer diameter and an "inner diameter" which defines a through hole adapted to receive a center rod. The overall longitudinal dimension of a stack is arbitrary depending on the number of pads and the spatial requirements of the pocket. In embodiments, the stack may range between about 5 inches and about 80 inches in an installed state, which may provide for travel (independently of any other component of the cushioning unit) in a range of about 0.35 inches to about 11.5 inches, depending on the dimensions and materials of the plates and elastomeric pads. For example only, and not by way of limitation, a stack having a length of 18.875 inches has been developed which will supply 3.75 inches of travel, and a stack of 28.875 inches is adapted for 6.125 inches of travel.

In embodiments, the selective cushioning units according to the invention are adapted to have a travel of about 6 inches to about 15 inches at maximum travel, although it would be apparent to a person of ordinary skill in the art that an additional elastomeric pad and associated plate could be added to a stack, and that would increase the travel and create softer cushioning, but at the expense of more space being required in the pocket.

As described in the aforesaid co-pending application Ser. No. 15/814,853, the rigid plates may be adapted to prevent over-compression of the elastomeric pads. For example, the plates may be made of cast or fabricated metal such as steel, and a stop surface may be provided on the periphery of the plate. Protrusions on the periphery of each plate permit a nesting arrangement of elastomeric units in stacks, which also contributes to alignment of the elastomeric units. Metal-to-metal contact on the stop surfaces occurs when an elastomeric pad between two adjacent plates is compressed a predetermined amount, such as 20-80%, and in embodiments 20-60%, of the uncompressed thickness of the pads. In embodiments, the pads in the front or draft stack compress about 0.5 inches (from their uncompressed thickness prior to installation) before metal to metal contact prevents further compression. In embodiments, the elastomeric pads are pre-stressed on installation. In embodiments, a protrusion on an elastomeric pad mates with a feature on an adjacent rigid plate to align the elastomeric units For example, and not by way of limitation, the uncompressed thickness of a pad may be about 1.70 inches and the outer diameter may be about 8.82. Compressed for installation with a force of about 32 klb, the installed thickness of the pads is about 1.24 inches. Under full compression, with metal-to-metal contact of plates preventing further compression of pads, the pad thickness may be about 0.91 inches and the outside diameter may reach 10.63 inches. Thus, in embodiments, the pads and plates are designed to allow compression of 20-80 percent, and in embodiments 40-60 percent, where the amount that the pad is compressed at full compression is expressed as a percentage of the uncompressed thickness of the pad, prior to installation. The same elastomeric material may be used for the elastomeric pads in the draft stack as in the buff stack, such as a thermoplastic elastomer. In certain non-limiting embodiments, the pads may be made of thermoplastic polyester, such as Arnitel® thermoplastic copolyester elastomer from DSM and Hytrel® thermoplastic polyester from Dupont. Suitable materials will typically have a Shore D durometer hardness of 40-70 and must have reasonably consistent properties across a temperature range that would be encountered during use.

From the fully compressed, pre-stressed and uncompressed thickness of each pad forming a stack, the modulus of the material, the number of pads and information obtained from static testing, an estimate may be obtained for the force profile of a stack (and a corresponding cushioning unit).

Figure 6:
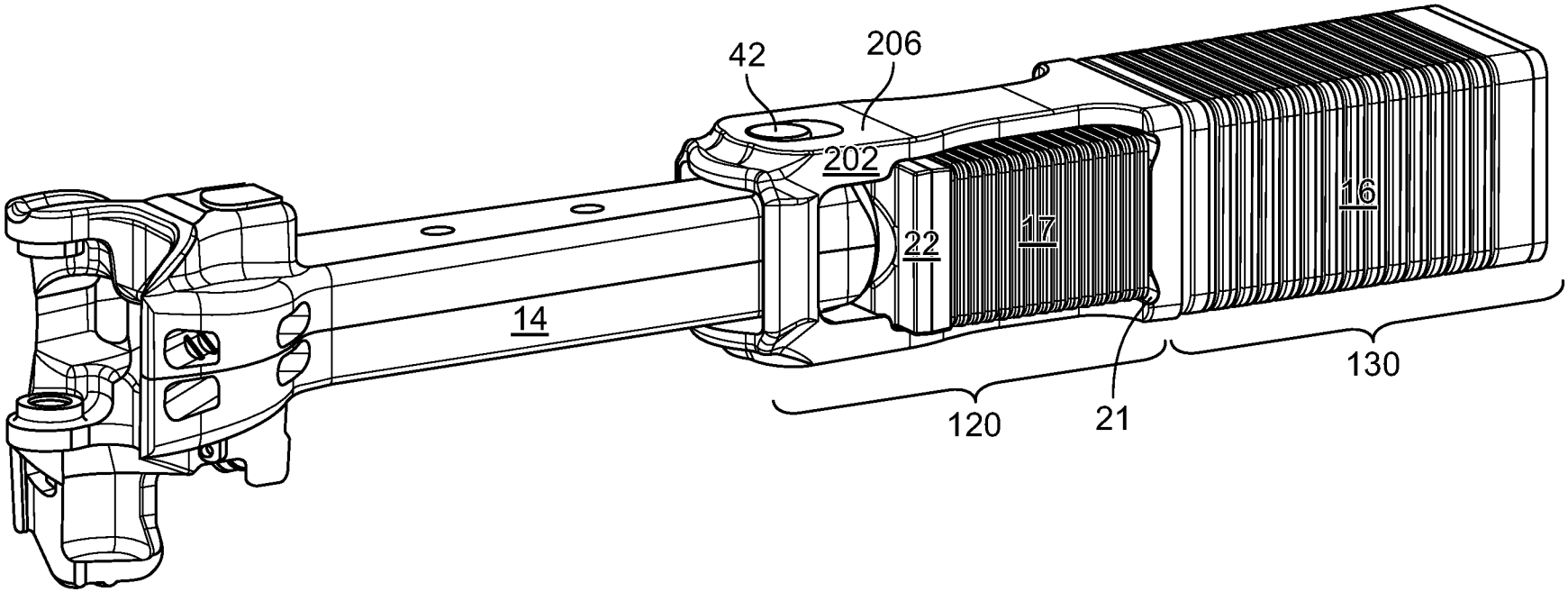
FIG. 6 depicts a selective cushioning unit according to an embodiment of the invention, connected to a coupler.

A cushioning unit according to one embodiment of the invention is depicted in FIG. 6, including a first stack 17 of fourteen elastomeric units positioned in front portion 120 forward of vertical wall 21 of the yoke 202 and behind the coupler follower 22, and a second stack 16 of eleven elastomeric units positioned in rear portion 130 behind the first stack 17, between a front buff plate and the rear buff plate. In this arrangement, first stack 17 absorbs buff and draft loads on coupler 14, whereas second stack 16 absorbs buff loads only. The impact tests described herein characterize the response to buff loads on the coupler 14, but cushioning of the recoil, which involves draft loads on first stack 17, is also evident in the data.

The configuration shown in FIG. 6 is "F-type", in that a pin 42 is used to attach coupler 14 to yoke 202, and walls 206 are on the top and bottom of the yoke. An "E-type" configuration, using a draft key to attach the coupler to the yoke using draft key, may also be used without departing from the scope of the invention, and indeed without changing the dimensions of elastomeric units in the stacks 16, 17. An important feature in some embodiments is that each of the metal plates in the second stack of elastomeric units has a face that substantially fills an interior cross-section of the sill (leaving enough room for the elastomeric units to move in the sill but not allowing movement out of alignment). Likewise, the plates in the first stack of elastomeric units fill the space within the yoke ensuring alignment of the elastomeric pads.

FIG. 1 depicts the amount of force transmitted to a railway car fitted with different types of cushioning at different speeds of impact. Area 200 shows the general operating area where draft gear may be expected to operate. Data 20 within area 200 show the performance of an individual draft gear (generated from available information). This curve is characterized by a sharp increase in the amount of force transmitted during an impact at above around 5 mph. Area 400 shows the general operating area where hydraulic units may be expected to operate. Data 40 within area 400 show the performance of an individual hydraulic unit having 13 inches of travel (generated from available information). Limiting curve 110 defines the maximum force that is permitted to be transmitted by a hydraulic unit having 6 to 9 inches of travel (as would be calculated according to AAR standard M-921B at a gross rail load (GRL) of 241 klbs). Limiting curve 120 defines the maximum force that would be permitted for a hydraulic unit having between 9 and 14 inches of travel using the same modified AAR M-921B standard. By way of comparison, data 30 was obtained for a selective cushioning unit substantially as described in connection with FIG. 6, based on the impact testing described herein. The tested unit had 6¾ inches of travel at maximum compression and fit in an AAR-specified EOC-9 pocket. The selective cushioning unit occupies an intermediate range 300 between draft gear and hydraulic units, as described below.

FIG. 2 through FIG. 5 show the results of impact testing generated at different impact velocities for a selective cushioning unit according to the invention installed in a pocket length of about 38¾ inches between front and rear lugs of a standard center sill. For this size pocket, a selective cushioning unit according to one embodiment of the invention may be provided with fourteen elastomeric units positioned in a front stack, and eleven elastomeric units in the second stack, such that the total travel for the unit is about 6¾ inches.

Although testing must be performed for each unit, the results are expected to be scalable. For an EOC-10 pocket length of 48¾ inches, a comparable cushioning apparatus may comprise, in one embodiment, eighteen elastomeric units, providing for a total travel of about 9¼ inches.

The amount of travel and the energy absorption may be estimated by measuring the amount of compression on individual pads or in a stack under static compression and multiplying by the number of pads. The results of such modeling are shown in dotted lines in FIGS. 2-5, wherein dotted line 70' represents the estimated force transmitted to an adjacent car as a function of travel. Dotted line 80' represents the recovery. The difference between the behavior of the pads (and the unit) in expansion versus compression is referred to as hysteresis. The ability of the cushioning unit to recover consistently is important to overall performance.

Figure 2:
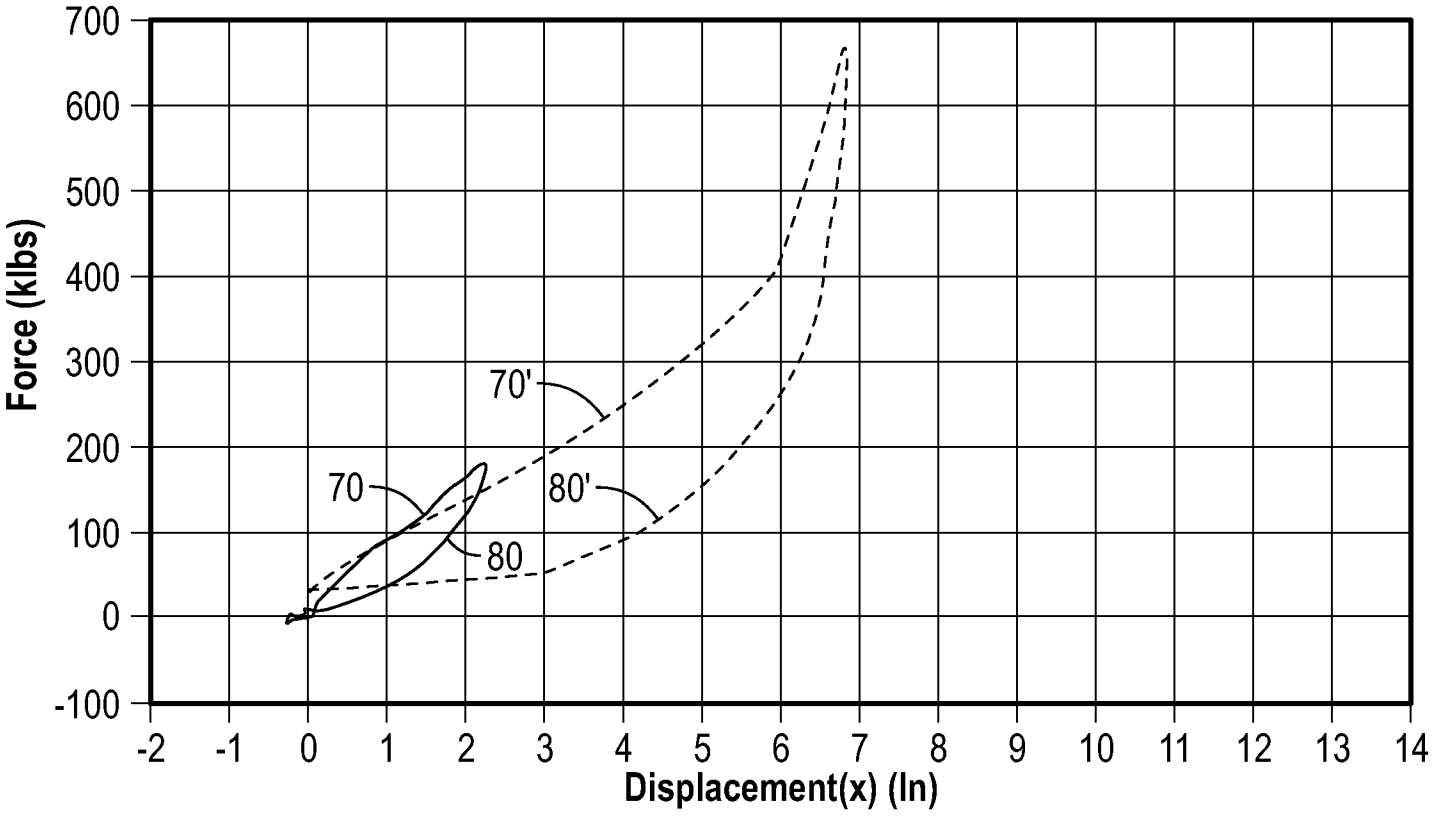
FIG. 2 is a force-displacement plot generated from a live impact test of a selective cushioning unit according to the invention at a velocity of 2.7 mph.

The plot of FIG. 2 was generated by a test approximating the AAR M-921B impact test, using test cars with a gross rail load (GRL) 241 klbs (slightly below the standard weight). Accordingly, the limiting curve 110 is calculated for GRL of 241 klbs. The speed of impact in FIG. 2 was 2.7 mph and the maximum travel was 2.34 inches. The maximum force measured was 181 klbs. The peak force at 2.7 mph is the starting point of line 30 in FIG. 1 (which is below the limiting curve 110). Because dotted lines 70' and 80' account for the pre-stress on the cushioning unit in its assembled state prior to impact and the measuring sensor does not "see" the pre-stress, the experimental plot is offset below the estimated curve near zero displacement.

Figure 3:
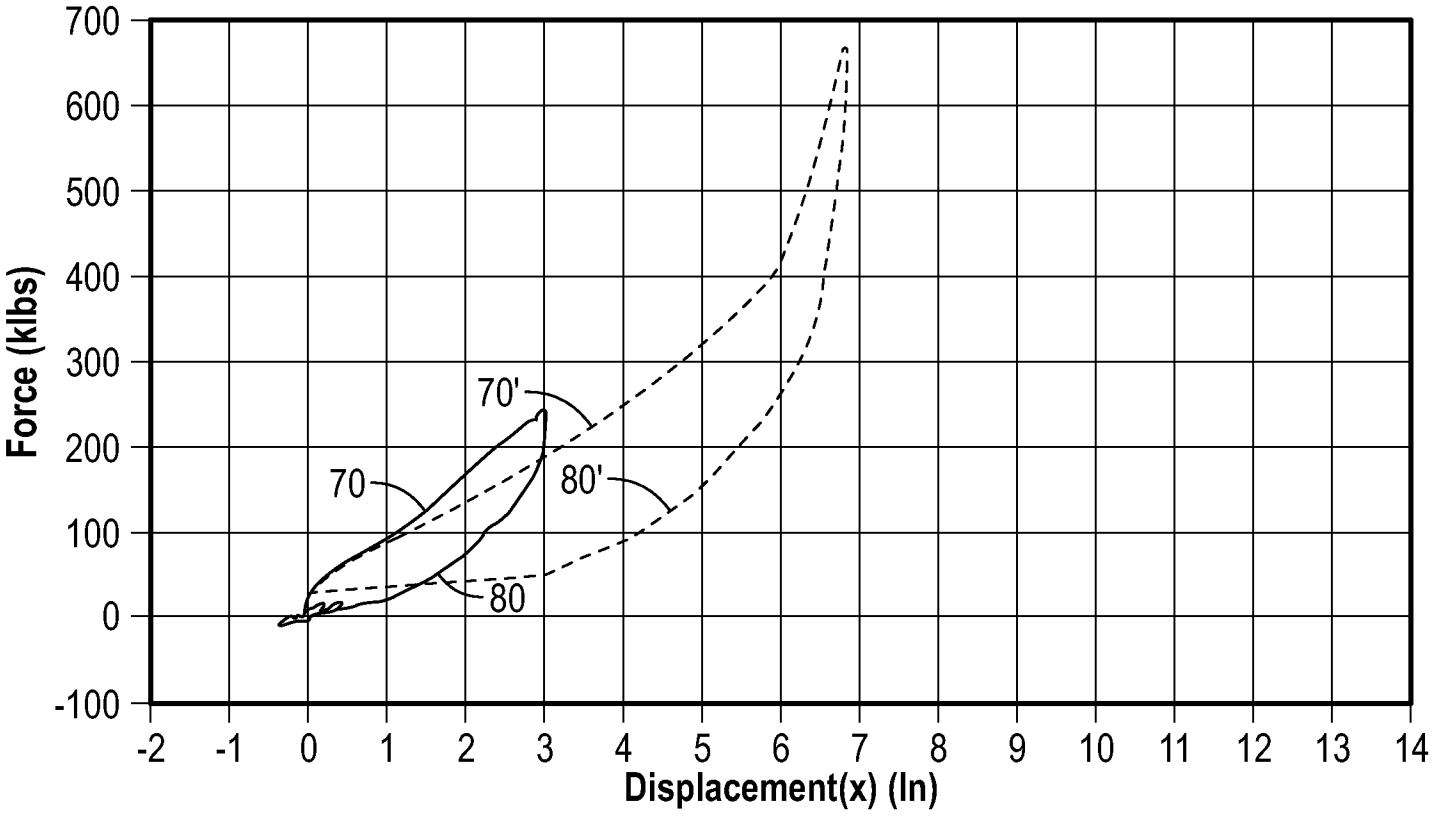
FIG. 3 is a force-displacement plot generated from a live impact test of a selective cushioning unit according to the invention at a velocity of 4.2 mph.
Figure 4:
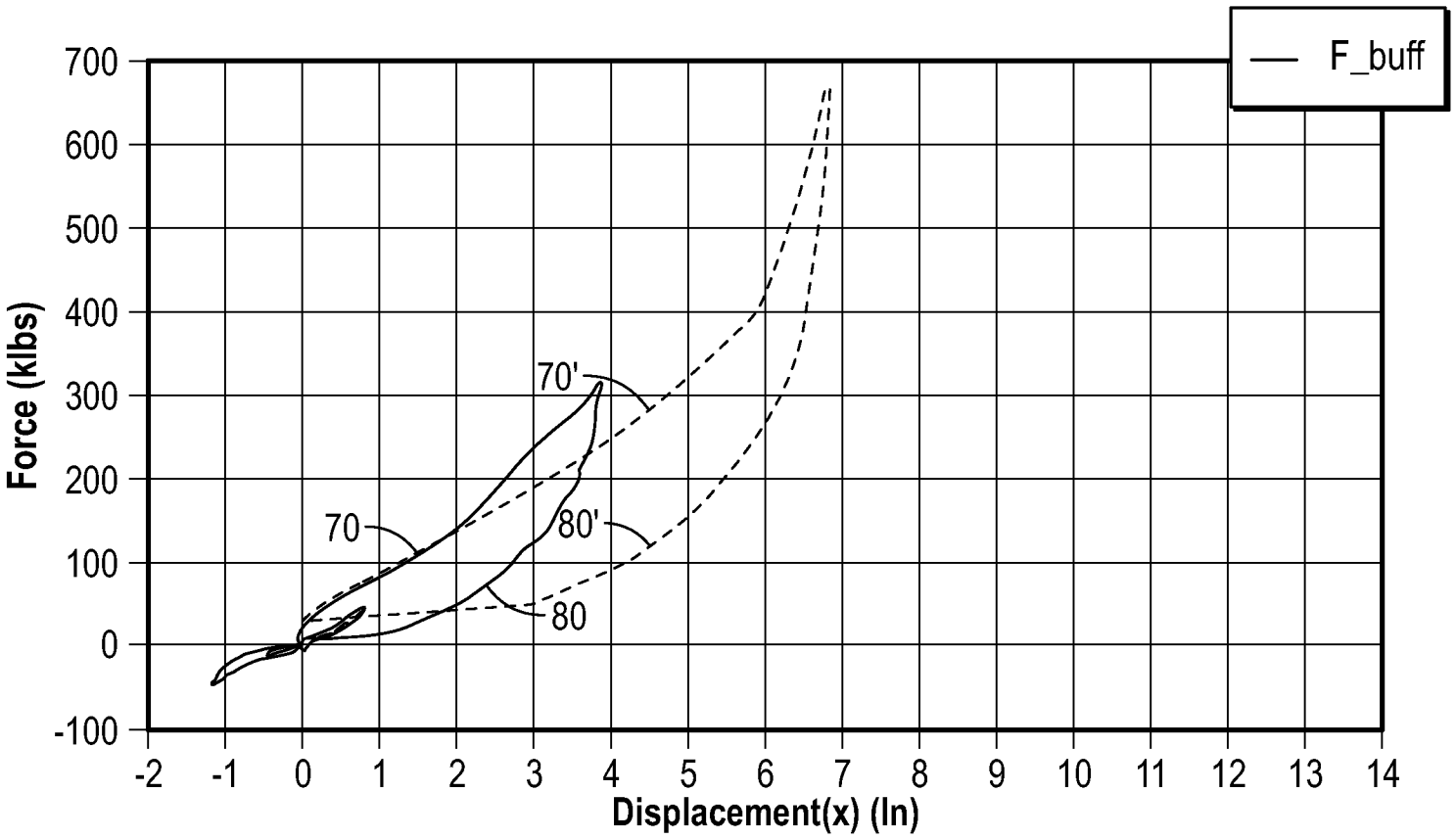
FIG. 4 is a force-displacement plot generated from a live impact test of a selective cushioning unit according to the invention at a velocity of 5.7 mph.
Figure 5:
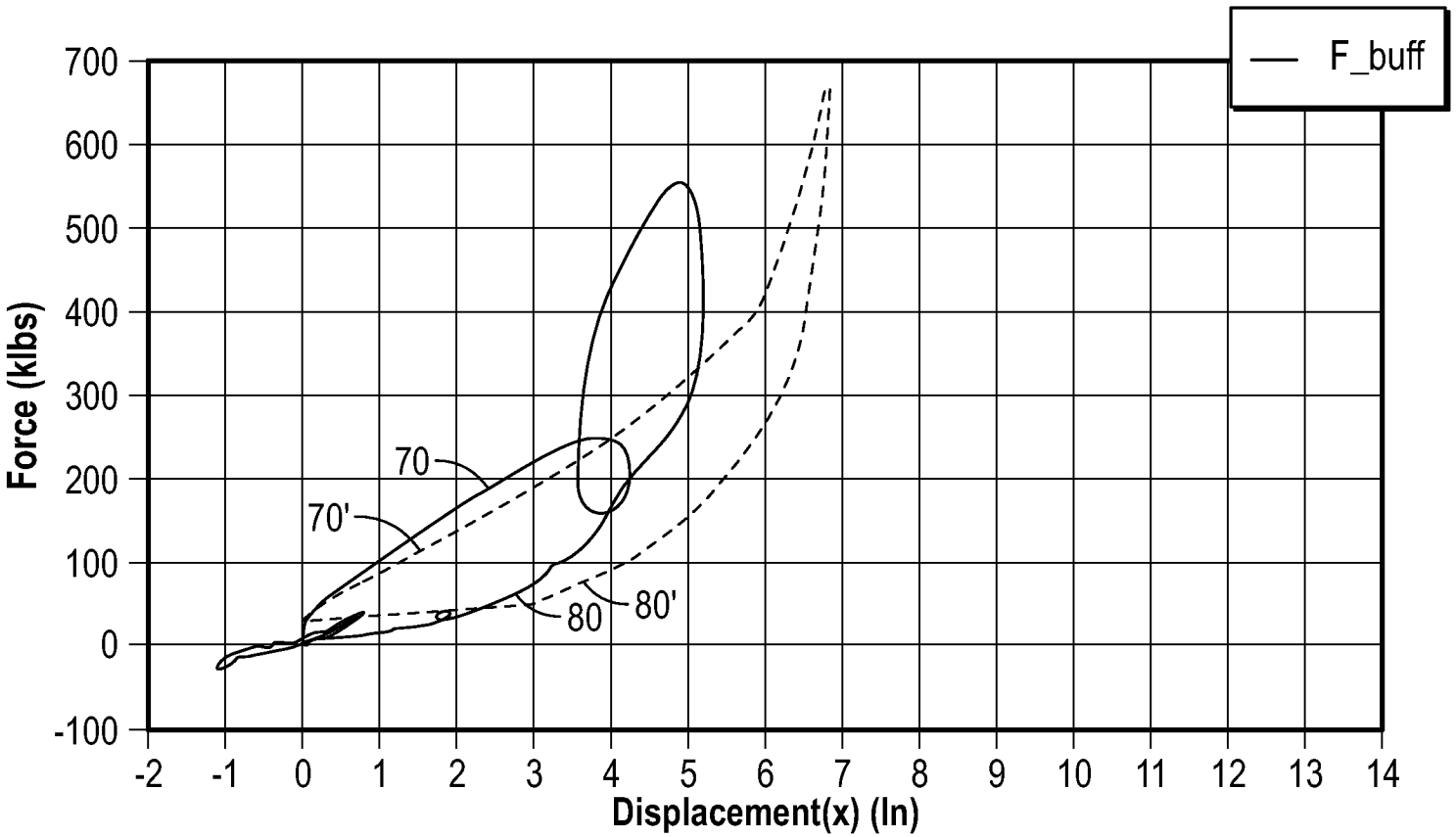
FIG. 5 is a force-displacement plot generated from a live impact test of a selective cushioning unit according to an embodiment of the invention at a velocity of 7.9 mph.

The same test was repeated at 4.2 mph, depicted in FIG. 3 and a peak force of 246 klbs was measured at a maximum travel of 3.08 inches. Likewise, represented in FIG. 4, the impact test was repeated and a peak force of 321 klbs was measured at a maximum travel of 3.99 inches. In FIG. 5, a peak force of 580 klbs and a maximum travel of 5.25 inches were measured at 7.9 mph impact velocity. The peak forces measured at each velocity are plotted in FIG. 1, showing that the maximum force transmitted fall below the modified limiting curve 110. Near-vertical drops at points along the force-displacement curve during compression reflect the absorption of draft loads on the coupler caused by recoil. As expected, more "noise" is observed in the data when the test is conducted at higher speeds. Accordingly, the data (for all of the tests) were filtered at 30 Hz for better presentation. These data show that with the amount of travel permitted for an apparatus having two stacks of elastomeric units according to the invention in an AAR standard EOC 9 pocket, the maximum force transmitted to a coupler can be maintained below 1.5 times the weight of the impact car where the weight of the car is 240 klbs. At higher speeds, the maximum force transmitted to a coupler at a speed of 10 mph may be maintained 4.0 times the weight of the impact car. And the maximum force transmitted to a coupler (in klbs) at a speed between 6 mph and 10 mph is defined by a line having slope 0.625, consistent with the AAR test. The expectation is that a larger pocket allowing greater travel will also meet the AAR standards currently used for hydraulic unit.

Pads in the stack 16 may have the same general shape as pads in the stack 17 but they are scaled larger. The maximum design force of the larger pads is higher due to larger surface area, but the surface pressure on each pad is about the same.

Hysteresis may be expressed as the ratio of energy absorbed by cushioning unit ($W_A$) to the energy input during impact ($W_E$). In embodiments a cushioning unit according to the invention will have a $W_A/W_E$ ratio of 0.3 to 0.65. The large distance between the compression and release curves in FIGS. 2-5 indicates relatively high hysteresis for a cushioning unit according to the invention. Calculated values from the impact tests of FIGS. 2-5 for each impact speed are as follows:

TABLE 1

| Velocity (mph) | Energy (ft-klbs) |
|---|---|
| 2.7 | 18 |
| 4.2 | 34 |
| 5.7 | 50 |
| 7.9 | 136 |

The impact tests of FIGS. 2-5 utilized a selective cushioning unit according to the invention, having a possible travel at full compression of 6¾ inches (the maximum travel exhibited was 5.25 inches) attached with appropriate instrumentation to the coupler of a "hammer" car, and the force of impact between the cushioned car and a railway train having a loaded weight of about 241 klbs was measured at different impact velocities, in a range from about 2.7 mph to about 7.9 mph. The maximum force dissipated at each impact velocity was plotted to generate the force-velocity plot of FIG. 1.

Figure 7:
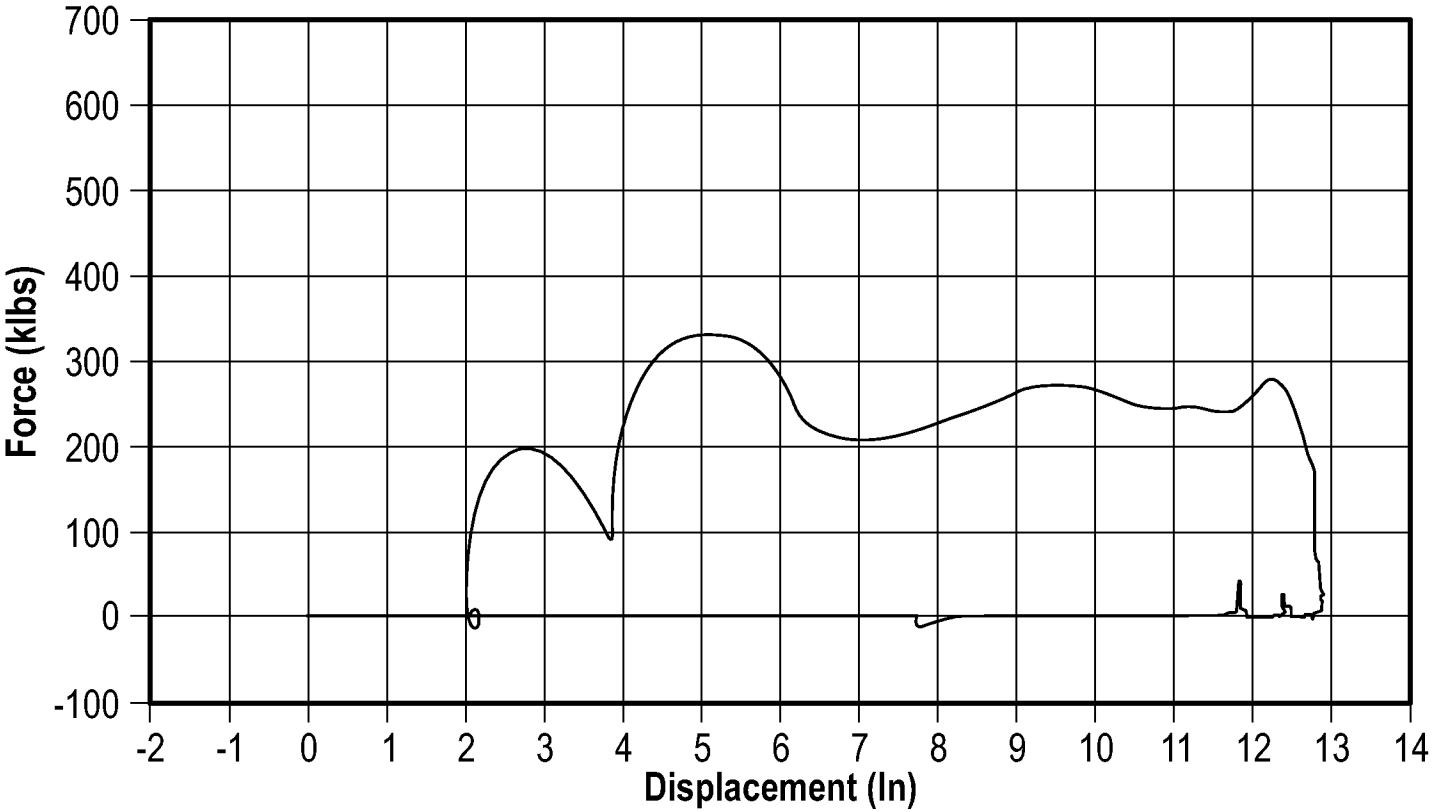
FIG. 7 (Prior Art)
FIG. 7 is a force-displacement plot generated from a live impact test of a hydraulic cushioning unit according to the prior art having a 13-inch stroke at a velocity of 7.8 mph.

The selective cushioning units described herein have a force absorption profile intermediate that of a standard draft gear and a conventional hydraulic unit. The tests described herein to characterize performance of cushioning units according to the invention are based on the AAR M-921B standard for hydraulic units, but the protocol was not identical to the standard. FIG. 7 depicts the performance of a hydraulic cushioning unit tested in a 7.8 impact test, with the same protocol that was used to generate FIGS. 2-5. in a 7.8 mph impact, with data being similarly filtered.

In general, the agreement between calculated and measured results provides confidence in the travel and energy absorption of the cushioning apparatus when the apparatus is lengthened or shortened to accommodate more pads or fewer pads. In tests involving actual railway cars with cushioning units installed, the speed of impact may be increased until maximum travel for the unit is achieved. For some selective cushioning units according to the invention, including those represented on the impact tests described below, the maximum travel is about 6¾ inches.

The description of the foregoing preferred embodiments is not to be considered as limiting the invention, which is defined according to the appended claims. The person of ordinary skill in the art, relying on the foregoing disclosure, may practice variants of the embodiments described without departing from the scope of the invention claimed. A feature or dependent claim limitation described in connection with one embodiment or independent claim may be adapted for use with another embodiment or independent claim, without departing from the scope of the invention.

What is claimed is:

1. An end-of-car cushioning apparatus for a railway car, comprising:

a yoke having a length, a front end, and a rear end opposite the front end, and having aligned apertures at the front end adapted to receive a pin or key for attaching the yoke to a railway car coupler, and having a vertical wall at the rear end;

a coupler-receiving member adapted to receive buff force from the coupler and adapted to move inside the yoke;

a first stack of elastomeric units positioned between the coupler-receiving member and the vertical wall of the yoke, wherein said first stack of elastomeric units is compressed in response to buff and draft loads on the coupler;

a second stack of elastomeric units positioned behind the vertical wall of the yoke, wherein said second stack of elastomeric units is compressed in response to buff loads on the coupler, each elastomeric unit comprising a metal plate and an elastomeric pad and wherein each metal plate has a stop surface which causes metal-to-metal contact on the stop surface when the elastomeric pad on the metal plate is compressed a predetermined amount; wherein, the maximum force transmitted to a coupler with the cushioning apparatus during impact at a speed below 6 mph is 1.5 times the weight of the impact car; wherein the maximum force transmitted to a coupler at a speed of 10 mph is 4.0 times the weight of the impact car; and wherein the maximum force transmitted to a coupler (in klbs) at a speed between 6 mph and 10 mph is defined by a line having slope 0.625.

2. The end of car cushioning apparatus according to claim 1, wherein the maximum travel of the cushioning apparatus is about 6 to about 15 inches.

3. The end of car cushioning apparatus according to claim 1, wherein the maximum travel of the cushioning apparatus is about 6¾ inches.

4. The end-of-car cushioning apparatus according to claim 1, wherein, each elastomeric unit in the first stack comprises a metal plate having a vertically oriented face and an elastomeric member in a middle portion of the vertically oriented face; wherein at least one of said plates comprises an edge portion extending around the elastomeric member, said edge portion having a front surface feature that cooperates with a rear surface in an edge portion of an adjacent plate; and wherein at full compression of the first stack, contact between the front surface feature and the rear surface of an adjacent plate prevents compression of an elastomeric member between them beyond a predetermined thickness.

5. The end-of-car cushioning apparatus according to claim 4, wherein, each elastomeric unit in the second stack comprises a plate having a vertically oriented face and an elastomeric member in a middle portion of the vertically oriented face; wherein each plate in said second stack comprises an edge portion extending around the elastomeric member, said edge portion having a front surface feature that cooperates with a rear surface feature in an edge portion of an adjacent plate; wherein at full compression of the second stack, contact between the front surface feature and the rear surface feature of adjacent plates prevents compression of an elastomeric member between them beyond a predetermined thickness.

6. The end of car cushioning apparatus according to claim 5, wherein all of the elastomeric units in the first stack have a raised feature on the respective edge portion of the plate that mates with a recessed feature in an adjacent plate so that all of the elastomeric units in the first stack are nested.

7. The end of car cushioning apparatus according to claim 6, wherein all of the elastomeric units in the first and second stack have a raised feature on the respective edge portion of the plate that mates with a recessed feature in an adjacent plate, so that all of the elastomeric units in the first and second stack are nested.

8. The end of car cushioning apparatus according to claim 1, adapted to be positioned between front and rear stops of an AAR Standard EOC-8, EOC-9 or EOC-10 pocket.

9. The end of car cushioning apparatus according to claim 5, wherein each of the metal plates in the second stack of elastomeric units has a face that substantially fills an interior cross-section of the sill.

10. The end of car cushioning apparatus according to claim 1, wherein the first stack of elastomeric units substantially fills a cross section of the yoke vertically and substantially fills a cross section of the sill laterally.

11. An end-of-car cushioning apparatus for a railway car, comprising:

a yoke having a length, a front end, and a rear end opposite the front end, and having aligned apertures at the front end adapted to receive a pin or key for attaching the yoke to a railway car coupler, and having a vertical wall at the rear end;

a draft gear positioned between the vertical wall and the front end of the yoke;

a second stack of elastomeric units positioned behind the vertical wall of the yoke, wherein said second stack of elastomeric units is compressed in response to buff loads on the coupler, each elastomeric unit in said second stack comprising a metal plate and an elastomeric pad and wherein each metal plate has a stop surface which causes metal-to-metal contact on the stop surface when the elastomeric pad on the metal plate is compressed a predetermined amount; wherein, a maximum force transmitted to a coupler with the cushioning apparatus during impact at a speed below 6 mph is 1.5 times the weight of the impact car; wherein a maximum force transmitted to a coupler at a speed of 10 mph is 4.0 times the weight of the impact car; and wherein a maximum force transmitted to a coupler (in klbs) at a speed between 6 mph and 10 mph is defined by a line having slope 0.625.

12. The end of car cushioning apparatus according to claim 11, wherein the second stack of elastomeric units is a nested set of elastomeric units each comprising a rigid metal plate with an elastomeric pad in a center of each plate, each plate having a protrusion and/or an indentation for nesting with an adjacent plate at full compression of the pads, and wherein the set of elastomeric units is aligned and held together by a rod through a center portion of each plate.

13. An end-of-car cushioning apparatus for a railway car, comprising:

a rigid metal front plate, a rigid metal rear plate, a nested set of elastomeric units held between the front plate and the rear plate by at least one rod, each said elastomeric unit comprising a rigid metal plate with an elastomeric pad in a center portion thereof, wherein each plate has a protrusion and/or an indentation at a peripheral portion thereof for nesting with an adjacent plate to prevent compression of the elastomeric pads beyond a predetermined compression, and wherein the front plate, rear plate and each elastomeric unit plate all have substantially the same vertical cross-sectional dimension, which substantially fills a lateral dimension of a railway car center sill, and wherein the nested set of elastomeric units is adapted to be positioned behind a railway car yoke rear wall.

14. The end-of-car cushioning apparatus according to claim 13, wherein the rod is flush mounted in at least the front plate and passes through the center of the elastomeric pads.

15. The end-of-car cushioning apparatus according to claim 13, wherein the rod is adapted to apply a pre-stress to the nested set of elastomeric units, and wherein a distance between the front plate and the rear plate at maximum compression of the set of elastomeric units is reduced in a range of about 6 to about 10 inches from a pre-stress distance between the front plate and the rear plate.

16. The end-of-car cushioning apparatus according to claim 15, wherein the vertical cross section of the front plate, rear plate, and each plate of the elastomeric units is the same as the vertical cross section of a railway car center sill.

* * * * *